United States Patent [19]

Bothwell

[11] 3,978,525

[45] Sept. 7, 1976

[54] HEAD AND CHEST PROTECTORS FOR EXAMPLE FOR MOTOR CYCLISTS

[76] Inventor: Peter William Bothwell, 114 Shipston Road, Stratford-upon-Avon, England

[22] Filed: Jan. 6, 1975

[21] Appl. No.: 538,833

[30] Foreign Application Priority Data

Jan. 5, 1974 United Kingdom ..... 563/74

[52] U.S. Cl. ..... 2/424

[51] Int. Cl.[2] ..... A42B 3/02

[58] Field of Search ..... 2/1, 2, 2.1 R, 2.1 A, 2/3 R, 205, 206; 280/290, 150 SB; 188/1 C; 297/386, 389; 244/122 AG; 242/107.4 B

[56] References Cited

UNITED STATES PATENTS

| | | | |
|---|---|---|---|
| 65,760 | 6/1867 | McKeen | 2/2.1 R |
| 2,680,476 | 6/1954 | Saffell | 280/150 S B X |
| 3,074,669 | 1/1963 | Bohlin | 280/290 X |
| 3,329,464 | 7/1967 | Barwood et al. | 297/389 |
| 3,531,061 | 9/1970 | Davies | 242/107.4 B |
| 3,666,198 | 5/1972 | Neumann | 297/386 X |
| 3,675,650 | 7/1972 | Domyan et al. | 2/2.1 R X |
| 3,707,004 | 12/1972 | Kapitan et al. | 2/2.5 |
| 3,818,509 | 6/1974 | Romo et al. | 2/3 R |
| 3,879,761 | 4/1975 | Bothwell | 2/3 R |

*Primary Examiner*—Werner H. Schroeder
*Assistant Examiner*—Moshe I. Cohen
*Attorney, Agent, or Firm*—A. Yates Dowell, Jr.

[57] ABSTRACT

A head, neck and chest protector, for example for a motor cyclist, comprising a rigid outer shell which comprises a head section formed wholly to enclose the head of the wearer and having a transparent part at the front thereof, a neck section rigidly connected to the head section and formed to surround the neck of the wearer and a chest section rigidly connected to the neck section and formed to extend over the upper chest of the wearer, and a helmet for fitting on the head of the wearer which is located within a cavity in the head section of the outer shell, the cavity being larger than the helmet so that the latter is movable therein and the helmet being suspended in the cavity by a plurality of elongate elements which are attached to the helmet at different locations over its outer surface and are connected to an inertia reel adapted normally to permit free movement of the helmet relative to the outer shell but being responsive to movement of the helmet at an acceleration above a predetermined value to bring into operation a shock absorber which shock damps movement of the helmet. The outer shell is externally generally of bullet-shape with a rounded nose.

6 Claims, 8 Drawing Figures

FIG.5.
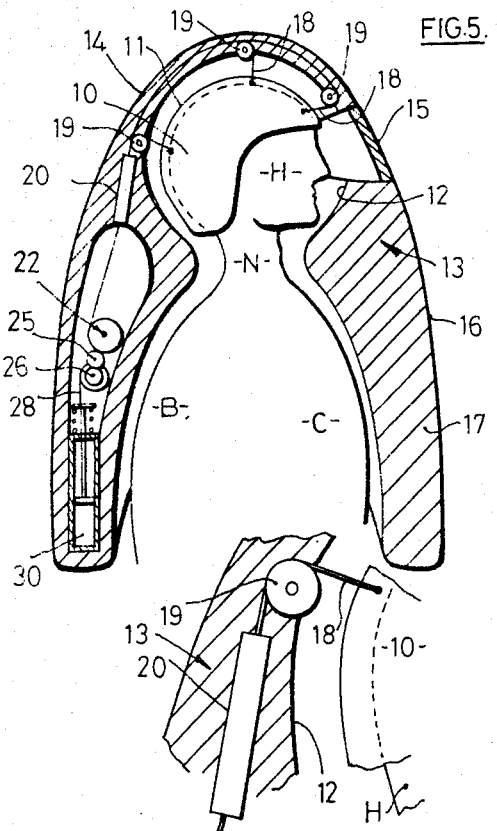
FIG.6.
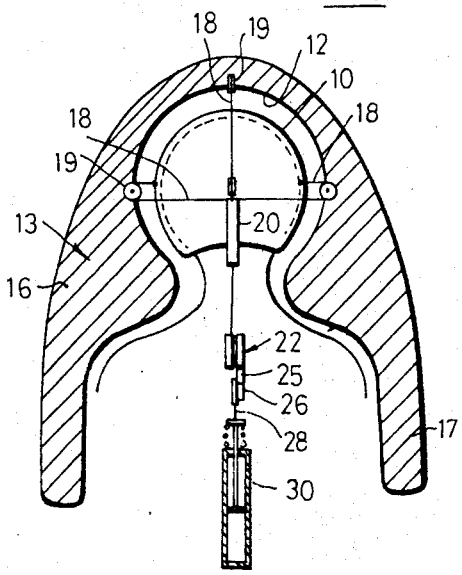
FIG.7.
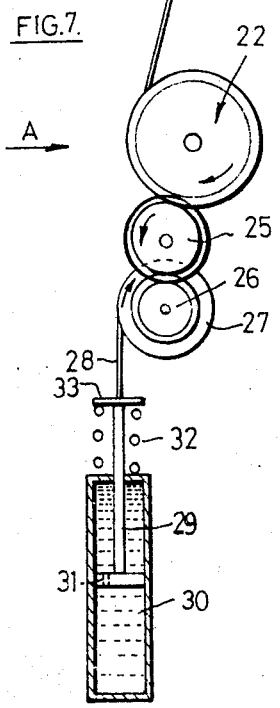
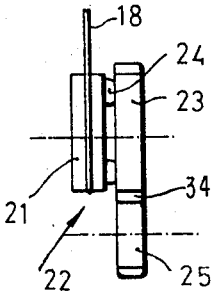
FIG.8

HEAD AND CHEST PROTECTORS FOR EXAMPLE FOR MOTOR CYCLISTS

FIELD OF THE INVENTION

This invention relates to head, neck and chest protectors, for example for protecting the head, neck and upper chest of a motor cyclist in a crash.

The object of the invention is to provide an improved form of head, neck and chest protector.

A particular object of the invention is to provide a protector which normally permits free movement of the wearer's head but which prevents any potentially injurious movement of the head in a crash.

A further particular object of the invention is to provide a protector which has a greater aerodynamic efficiency and is mechanically stronger at the neck section than previously proposed forms of protector.

SUMMARY OF THE INVENTION

According to a first aspect of the invention I provide a protector for protecting the head, neck and upper chest of a wearer, said protector comprising a rigid outer shell which comprises a head section formed wholly to enclose the head of the wearer and having a transparent part at the front thereof, a neck section rigidly connected to the head section and formed to surround the neck of the wearer and a chest section rigidly connected to the neck section and formed to extend over the upper chest of the wearer, and a helmet for fitting on the head of the wearer which is located within a cavity in the head section of the outer shell, the cavity being larger than the helmet so that the latter is movable therein and the helmet being suspended in the cavity by a plurality of elongate elements which are attached to the helmet at different locations over its outer surface and are connected to means for controlling movement of the helmet in the cavity.

Preferably the said means for controlling movement of the helmet in the cavity in the outer shell comprise means adapted normally to permit free movement of the helmet relative to the outer shell, i.e. turning and movement forwards backwards and sideways, but in the event of the helmet moving relative to the outer shell at an acceleration above a predetermined value, to shock damp movement of the helmet.

In a preferred embodiment the said means comprise an inertia reel having two rotary parts, the elongate elements being connected to a first one of said parts and the second part being connected to a shock absorber, the first part normally being freely rotatable relative to the second part to permit free movement of the helmet in the cavity in the outer shell and the inertia reel having means responsive to movement of the first part resulting from movement of the helmet relative to the outer shell at an acceleration above said predetermined value, to lock the two parts together so that the second part turns with the first part and movement of the two parts and hence movement of the helmet is shock damped by the shock absorber.

Preferably the shock absorber comprises a piston and cylinder unit and the second part of the inertia reel is operatively connected to the piston of the unit through a gearing adapted to produce a long stroke of the piston for a small movement of the helmet in the cavity in the outer shell with the two parts of the inertia reel locked together.

In an alternative arrangement the shock absorber is omitted and the second part of the inertia reel is fixed and the elongate elements are of a resiliently extensible material, e.g. Nylon, whereby when the first part of the inertia reel is locked to the second part as a result of a sudden movement of the helmet, the elongate elements stretch and thereby shock damp movement of the helmet.

The helmet may comprise a rigid shell to be secured to the wearer's head or it may simply comprise a cover or a number of straps to be secured over the head and having the elongate elements attached thereto. The helmet may be light in weight and therefore the wearer is not subjected to excessive neck strain.

According to a second aspect of the invention I provide a protector for protecting the head, neck and upper chest of a wearer, said protector comprising a rigid outer shell which comprises a head section formed wholly to enclose the head of the wearer and having a transparent part at the front thereof, a neck section rigidly connected to the head section and formed to surround the neck of the wearer and a chest section rigidly connected to the neck section and formed to extend over the upper chest of the wearer, and a helmet for fitting on the head of the wearer which is located within a cavity in the head section of the outer shell, the outer shell being formed so that the neck section thereof is externally of a width and breadth no smaller than the corresponding dimensions of the head section.

Preferably, the outer shell is generally of tapering form in a direction from the chest section towards the head section, the neck section being of a width and breadth slightly greater than the corresponding dimensions of the head section and the chest section being of a width and breadth slighty greater than the corresponding dimensions of the neck section. Thus, the outer shell may be generally of the shape of a bullet with a rounded nose.

BRIEF DESCRIPTION OF THE DRAWINGS

The invention will now be described by way of example with reference to the accompanying drawings, in which:

FIG. 5 is a sectional view of the protector shown in FIGS. 2 and 3, FIG. 6 is a sectional front view of the protector, FIG. 7 is an enlarged detailed view of part of FIG. 5, and FIG. 8 is a detailed view taken in the direction of arrow A in FIG. 7.

DESCRIPTION OF THE PREFERRED EMBODIMENT

Figure 4:
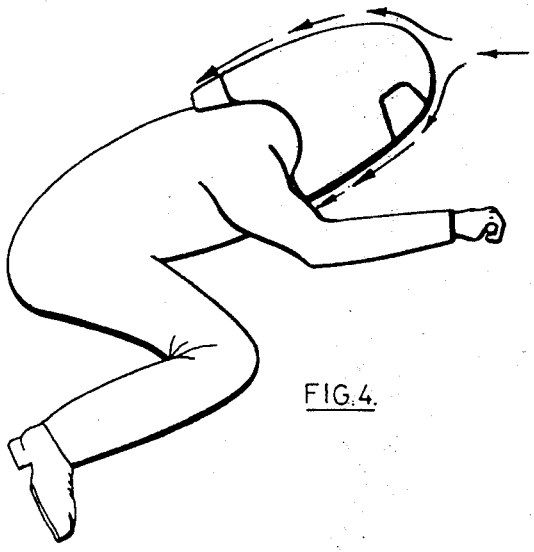
FIG. 4 shows the aerodynamic characteristics of the protector illustrated in FIGS. 2 and 3.

The protector shown in FIGS. 2 to 8 has been designed primarily for use by a motor cyclist, to protect his head, neck and upper chest in a crash. The protector comprises a helmet 10 to be fitted to the wearer's head H and having an outer surface 11 of part-spherical form. The helmet 10 is located within a part-spherical cavity 12 in a rigid outer shell generally designated 13 which comprises a head section 14 formed to enclose the wearer's head H and provided with a visor 15, a neck section 16 formed to surround the wearer's neck N, and a chest section 17 formed to extend over the wearer's shoulders and the upper parts of his chest C and back B. The shell 13 may terminate short of the wearer's arms as shown in FIG. 4 or the lower portion of the shell may be extended and have holes or cutaway portions to allow passage of the wearer's arms.

The helmet 10 comprises a rigid plastics shell having a soft lining contoured closely to fit the wearer's head and is provided with a chin strap (not shown) to enable the helmet to be firmly secured on the wearer's head.

Figure 1:
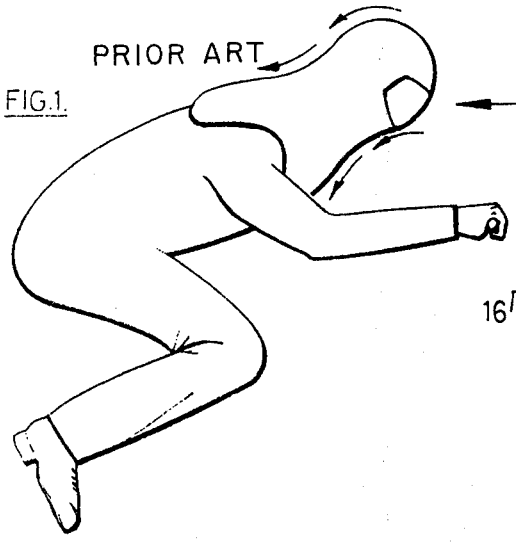
FIG. 1 shows the aerodynamic characteristics of a previously proposed form of head, neck and chest protector.
Figure 2:
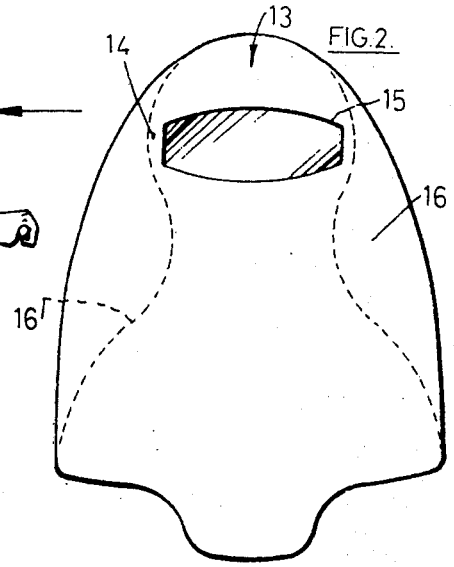
FIG. 2 is a front elevation of on form of head, neck and chest protector embodying the present invention.
Figure 3:
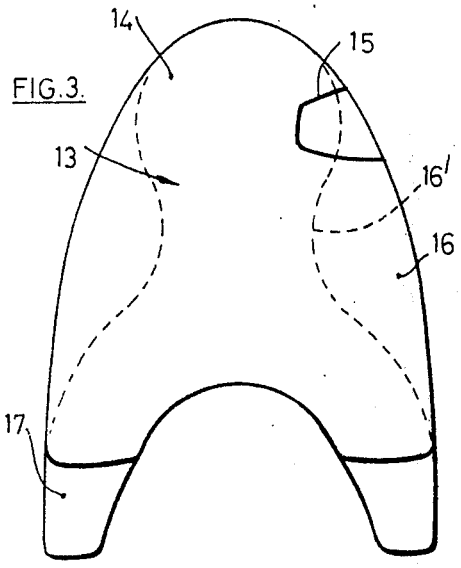
FIG. 3 is a side elevation of the protector shown in FIG. 2.

The rigid outer shell 13 is formed of a foamed plastics material sandwiched between a rigid plastics outer layer and a rigid plastics inner layer. The outer shell 13 is externally generally bullet-shaped. That is to say, it has a rounded top and tapers in a direction from the lower chest section 17 thereof towards the rounded upper head section 14 and the neck section 16 is not of concave form. If the neck section 16 were externally of a width and breadth less than the corresponding dimensions of the head and chest sections as shown in dotted lines at 16' in FIGS. 2 and 3, then eddy currents and turbulence would be set up around the protector, as shown in FIG. 1, when a motor cyclist wearing the protector is riding his cycle in a crouched position. By making the protector generally of bullet shape, the air flow over the protector is improved and eddying and turbulence are reduced as shown in FIG. 4.

A further advantage of making the protector of this shape is that it is stronger at the neck section 16, and in this regard it will be seen from FIG. 5 that the outer shell 13 may be of increased thickness at the neck section.

Referring particularly to FIGS. 5 to 8, it will be observed that the cavity 12 in the outer shell 13 in which the helmet 10 is located is larger than the helmet and the outer surface 11 of the helmet is normally spaced from the surface of the cavity. The helmet is suspended in this position by a plurality of cords 18 which are attached to the top, front, rear and sides of the helmet as shown and each of which extends outwardly at right angles to the surface of the helmet and passes over a pulley 19 mounted in the outer shell 13. The cords pass through cavities formed between the rigid inner and outer layers of the shell 13 and they are all brought together by a tube 20 embedded in the outer shell. The cords 18 pass through the tube 20 and are all connected to one rotary part 21 of an inertia reel generally designated 22 mounted in a cavity in the outer shell whereby movement of the wearer's head and the helmet 10 within the cavity 12 in the outer shell exerts a pull on the cords 18 and causes the rotary part 21 of the inertia reel to turn. The inertia reel has a second rotary part 23 and balls 24 interposed between ramps formed on the opposed faces of the two parts 21, 23 whereby in normal conditions of wear the wearer's head and the helmet 10 are freely movable within the cavity in the outer structure, the part 21 of the inertia reel turning relative to the part 23 which remains stationary, but in the event of a sudden movement of the wearer's head and the helmet, for example in a crash, resulting in the cords 18 being jerked, the balls 24 of the inertia reel become jammed between the ramps and lock the part 23 to the part 21 so that it turns with the latter.

The part 23 of the inertia reel is provided with a gear ring 34 which drives a smaller diameter gear wheel 25 which in turn drives a gear wheel 26 and a pulley 27 connected coaxially to the latter. Connected to and passing around this pulley is a cord 28 which is attached to the piston rod 29 of a shock absorber 30 mounted in the back part of the chest section 17 of the outer shell, the piston of the shock absorber being formed with a metering hole 31 opening at opposite sides thereof and the cylinder containing hydraulic fluid at both sides of the piston. Thus, the arrangement is that any movement of the motor cyclist's head and the helmet 10 relative to the outer shell 13 after locking of the inertia reel 22 is shock-damped, the cords 18 turning the pulley 27 through the inertia reel and the gearing 34, 25 and 26 hence moving the piston in the shock absorber 30 against the resistance presented by the hydraulic fluid passing at a restricted rate through the metering hole 31 in the piston. The gearing produces a long stroke of the piston compared with the extent of movement of the helmet relative to the outer shell.

By shock damping the movement of the helmet relative to the outer shell, the movement of the motor cyclist's head is slowed down and if the helmet hits the surface of the cavity in the outer shell the force of the impact is reduced, the outer shell deforming to absorb the energy of this slight impact.

A light spring 32 is provided between the upper end of the cylinder of the shock absorber 30 and a stop 33 on the piston rod 29 to return the piston to its original position when the shock absorber has been operated.

The pulleys 19 and 27, the tube 20, the gear ring 34, the gear wheels 25 and 26 and the shock absorber 30 may all be made of a plastics material.

The outer shell 13 may be provided with air ducts for ventilation purposes.

I claim:

1. A protector for protecting the head, neck and upper chest of a wearer, said protector comprising a rigid outer shell which comprises a head section formed with a cavity wholly to surround the head of the wearer and having a transparent part at the front thereof, a neck section rigidly connected to the head section and formed to surround the neck of the wearer and a chest section rigidly connected to the neck section and formed to extend over the upper chest of the wearer, and a helmet for fitting on the head of the wearer which is located within said cavity in the head section of the outer shell, the cavity being larger than the helmet so that the latter is movable therein and the helmet being suspended in the cavity by a plurality of elongate elements which are attached to the helmet at different locations over its outer surface and are connected to means adapted normally to permit free movement of the helmet in the cavity relative to the outer shell but in the event of the helmet moving relative to the outer shell at an acceleration above a predetermined value, to shock damp movement of the helmet.

2. A protector as claimed in claim 1 wherein the said means comprise an inertia reel having two rotary parts a first one of which has the elongate elements connected to it so as to be rotatable on movement of the helmet in the cavity relative to the outer shell and a second one of which is connected to a shock absorber operable on turning of the second part, the first part of the inertia reel normally being freely rotatable relative to the second part to permit free movement of the helmet in the cavity relative to the outer shell and the inertia reel having means responsive to turning of the first part resulting from movement of the helmet relative to the outer shell at an acceleration above said predetermined value, to lock the two parts together so that the second part turns with the first part and the shock absorber comes into operation to shock damp movement of the two parts and hence movement of the helmet.

3. A protector as claimed in claim 2 wherein the shock absorber comprises a piston and cylinder unit of which the cylinder is fixed relative to the outer shell, and the second part of the inertia reel is operatively connected to the piston of the unit through a step-up gearing so that, with the two parts of the inertia reel locked together, a long stroke of the piston is produced by a small movement of the helmet relative to the outer shell.

4. A protector as claimed in claim 3 wherein the second part of the inertia reel has a gear ring engaged with a smaller diameter gear wheel which is drivingly connected to a pulley, an elongate element being connected to and passing around the pulley and being attached to the piston of the shock absorber so as to move the piston in the cylinder on turning of the pulley by the gearing.

5. A protector as claimed in claim 1 wherein the elongate elements are attached to the top, front, rear and sides of the helmet and extend outwardly from the surface of the helmet at right angles thereto, the elements passing over or through guide means carried by the outer shell.

6. A protector for protecting the head, neck and upper chest of a wearer, said protector comprising a rigid outer shell which comprises a head section formed with a cavity wholly to surround the head of the wearer and having a transparent part at the front thereof, a neck section rigidly connected to the head section and formed to surround the neck of the wearer and a chest section rigidly connected to the neck section and formed to extend over the upper chest of the wearer, and a helmet for fitting on the head of the wearer which has a part-spherical outer surface and is located within said cavity in the head section of the outer shell, the cavity being larger than the helmet so that the latter is movable therein and the helmet being suspended in the cavity by a plurality of elongate elements which are attached to the top, front, rear and sides of the helmet, and extend outwardly from the outer surface of the helmet at right angles thereto, pass over or through guide means carried by the outer shell and are connected to means for controlling movement of the helmet in the cavity, said means comprising an inertia reel having two rotary parts and shock absorber comprising a piston and cylinder unit, a first one of the two parts of the inertia reel having the elongate elements connected to it so as to be rotatable on movement of the helmet in the cavity relative to the outer shell and a second one of said parts being connected through a step-up gearing to the piston of the shock absorber, the first part of the inertia reel normally being freely rotatable relative to the second part to permit free movement of the helmet in the cavity relative to the outer shell but the inertia reel having means responsive to turning of the first part resulting from movement of the helmet relative to the outer shell at an acceleration above a predetermined value, to lock the two parts together so that the second part turns with the first part and the piston is moved in the cylinder by turning of the second part whereby the shock absorber shock damps movement of the helmet.

* * * * *